United States Patent [19]

Lo Voi

[11] 4,345,757

[45] Aug. 24, 1982

[54] ANCHORED MASSAGE AND EXERCISING BAR

[76] Inventor: Raymond J. Lo Voi, 828 Liberty La., Rockaway Point (Queens), N.Y. 11697

[21] Appl. No.: 100,009

[22] Filed: Dec. 4, 1979

[51] Int. Cl.[3] ..... A63B 21/00

[52] U.S. Cl. ..... 272/127; 128/57; 272/900

[58] Field of Search ..... 272/93, 134, 142, 127, 272/136, 900; 128/25 R, 25 B, 57, 58, 60–63

[56] References Cited

U.S. PATENT DOCUMENTS

| | | | |
|---|---|---|---|
| 662,083 | 11/1900 | McFadden | 272/127 |
| 718,594 | 1/1903 | Bailey | 128/57 |
| 1,123,272 | 1/1915 | Goodman | 272/136 |
| 1,609,544 | 12/1926 | Hamersley et al. | 128/57 |
| 1,702,991 | 2/1929 | Bechmann | 128/58 |
| 1,776,806 | 9/1930 | Carlson | 128/57 |
| 2,742,251 | 4/1956 | Udvardy | 128/61 X |

FOREIGN PATENT DOCUMENTS

| | | | |
|---|---|---|---|
| 140735 | 2/1935 | Fed. Rep. of Germany | 128/58 |
| 1235695 | 5/1960 | France | 128/57 |
| 275261 | 3/1928 | United Kingdom | 128/57 |

*Primary Examiner*—Richard C. Pinkham
*Assistant Examiner*—William R. Browne
*Attorney, Agent, or Firm*—Heslin & Watts

[57] ABSTRACT

A pair of exercising bars with flexible shafts and a plurality of rollers mounted thereon are anchored at one end at selected heights. This enables the operator to stand between them and massage two different parts of his body at the same time, adjusting the height as necessary.

2 Claims, 8 Drawing Figures

ANCHORED MASSAGE AND EXERCISING BAR

BACKGROUND AND SUMMARY OF THE INVENTION

This invention relates to exercising bars of the type operated by the user.

It is well known to be highly beneficial to massage and exercise the muscles of the human body through the use of hand held exercising bars. Examples of such devices are depicted in the following U.S. Pat. Nos.: 4,002,163; 3,565,063; and 1,882,490. A more elaborate system is described in U.S. Pat. No. 3,465,750 which shows an exercising device comprised of a stand for the user with two hand bars arranged to move or pivot about an axis, preferably horizontal, and which can be gripped by the user and moved against his own body to effect a massaging action. Such a device is relatively nonportable.

A disadvantage associated with hand held exercising bars as heretofore known lies in the fact that they must be gripped by both hands of the user. This limits the use of the device to one portion of the body at a time. Moreover, it requires a considerable expenditure of energy to bend such devices around irregularly shaped portions of one's body while maintaining its movement over the body.

It is an object of this invention to provide a relatively simple, economical and yet efficient exercising and massaging system which is relatively portable.

It is a further object of this invention to provide such a system in which the user is assisted in shaping the operative elements of the massager to conform to the various contours of his body during use.

It is a further object of this invention to provide an exercising and massaging system utilizing at least one, but preferably two, exercising bars, each of which can be operated with one hand.

These and other objects of the invention are carried out by providing an exercising bar having a flexible shaft with a handle rotatably mounted on one end and means pivotally anchoring its other end to some stationary object such as a wall. A plurality of corrugated rollers are rotatably mounted on said shaft to provide the desired massaging action as the bar is moved over various parts of the body. In the preferred embodiment of the invention, the anchoring means are adjustable in order to provide a variety of heights at which said other end of the exercising bar can be fixed for pivotal movement.

BRIEF DESCRIPTION OF THE DRAWINGS

In FIG. 1, there is shown an exercising bar 10 having a connector member 12 on one end and a handle 14 mounted on the other. A plurality of massage rollers 16 are mounted between connector 12 and handle 14. Each of the rollers 16 is shown to be separated by a pair of washers 18 and as more clearly shown in FIG. 4, handle 14 is provided with flaired ends 20. Connector 12 is comprised of a neck 13 upon which a ball 15 is mounted.

As shown in FIGS. 2, 4 and 5, connector 12 and handle 14 are connected by a central shaft 22. This shaft consists of a helically wound flat spring. Spring 22 is attached to connector 12 by spot welding to neck 13. Likewise, an axle member 24 is attached by spot welding to the other end of spring 22. Axle 24 is threaded at its outer end and handle 14 is held in place by means of nut 26. A washer 18 is provided between the inner end of handle 14 and the first roller 16.

Figure 1:
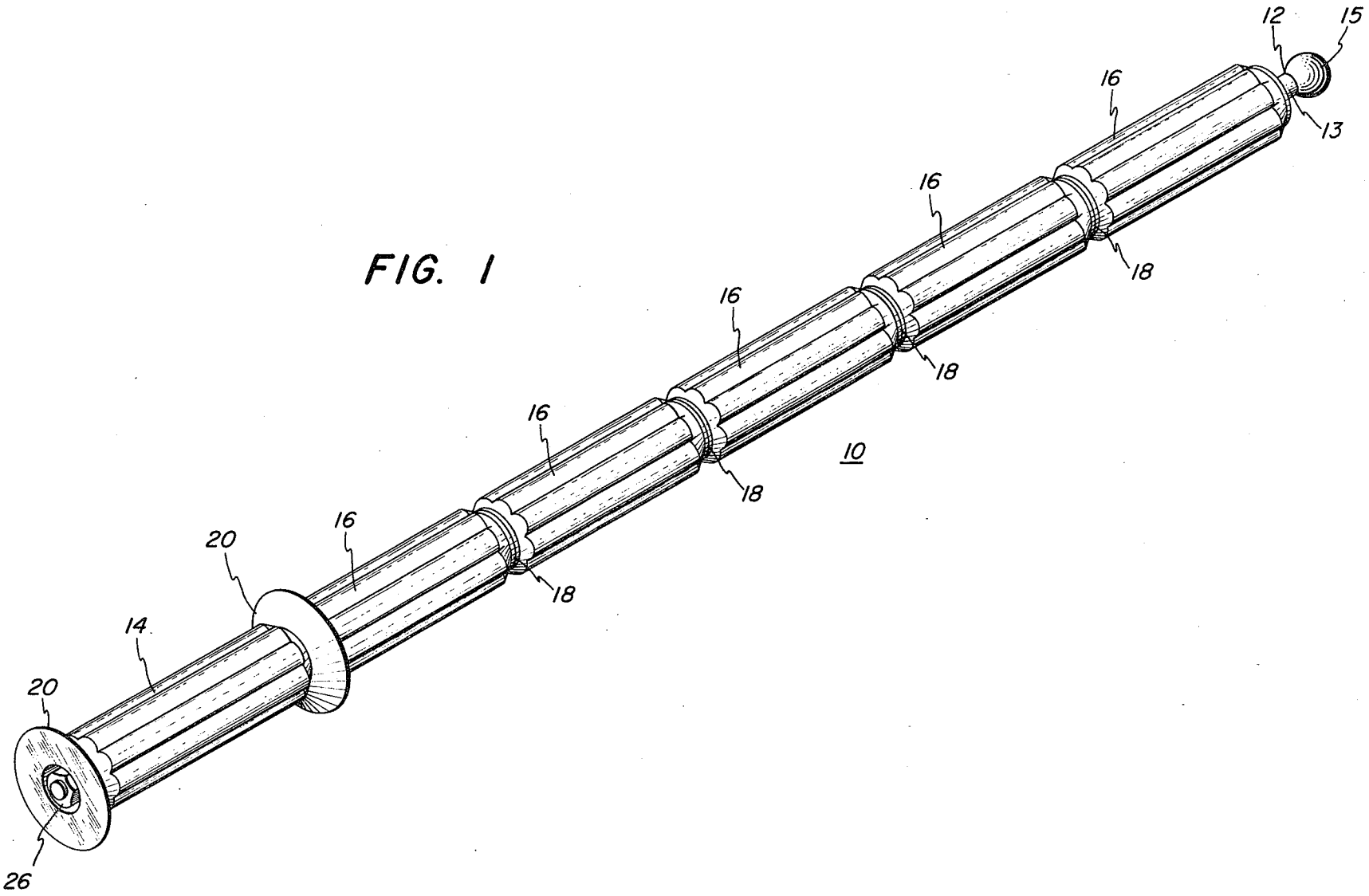
FIG. 1 is a perspective view of an exercising bar used in this invention.
Figure 2:
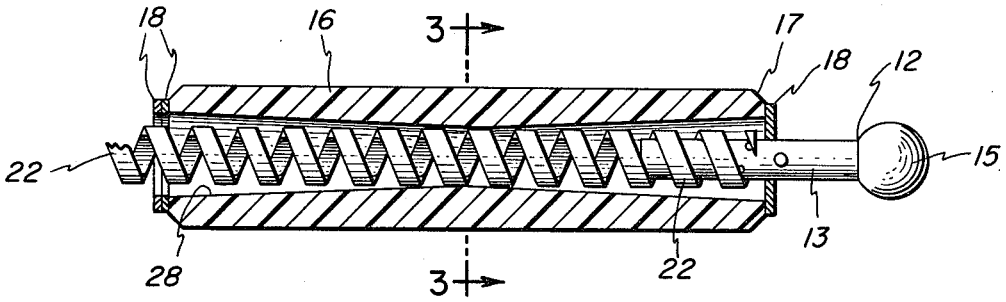
FIG. 2 is a central cross-sectional view of a portion of the exercising bar taken along lines 2—2 in FIG. 1.
Figure 3:
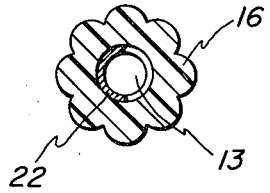
FIG. 3 is a cross-sectional view taken on line 3—3 of FIG. 2.
Figure 4:
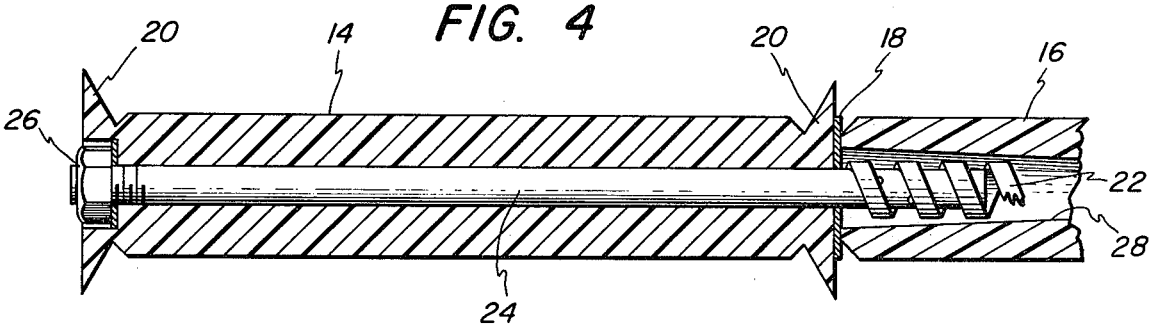
FIG. 4 is a cross-sectional view of another portion of the exercising bar taken along lines 4—4 of FIG. 1.
Figure 5:
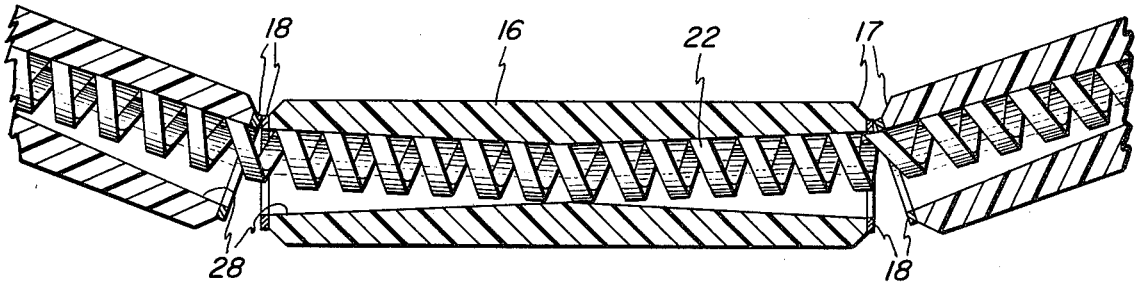
FIG. 5 is a cross-sectional view of a portion of the exercising bar of FIG. 1 showing the relative location of the parts of the invention when the bar is flexed.

Each roller 16 is provided with a central bore 28. Bore 28 is preferably tapered from a relatively larger diameter at either end of roller 16 to a relatively smaller diameter at the center of roller 16. This tapering is important because it permits the rollers to remain rotatable when the bar 10 is flexed, as shown in FIG. 5. Without tapering, the rollers would tend to bind in such cases on shaft 22. It can also be noted that each of the rollers 16 has a beveled portion 17 at either end. The purpose for this is to prevent pinching the skin of the user as exercising bar 10 is operated in a flexed configuration.

As concerns materials, ball 15 and neck 13 may be made in one piece from a suitable grade of steel which will be durable enough to provide a reasonable length of service. Spring 22 may be made from spring steel. Washers 18 may be made from Teflon or any other suitable material. Rollers 16 are preferably made of wood or plastic, but one may also use a resilient material such as rubber which will yield when pressed and rolled over the parts of the human body. Handle 14 may be made of plastic or any other suitable material.

Figure 6:
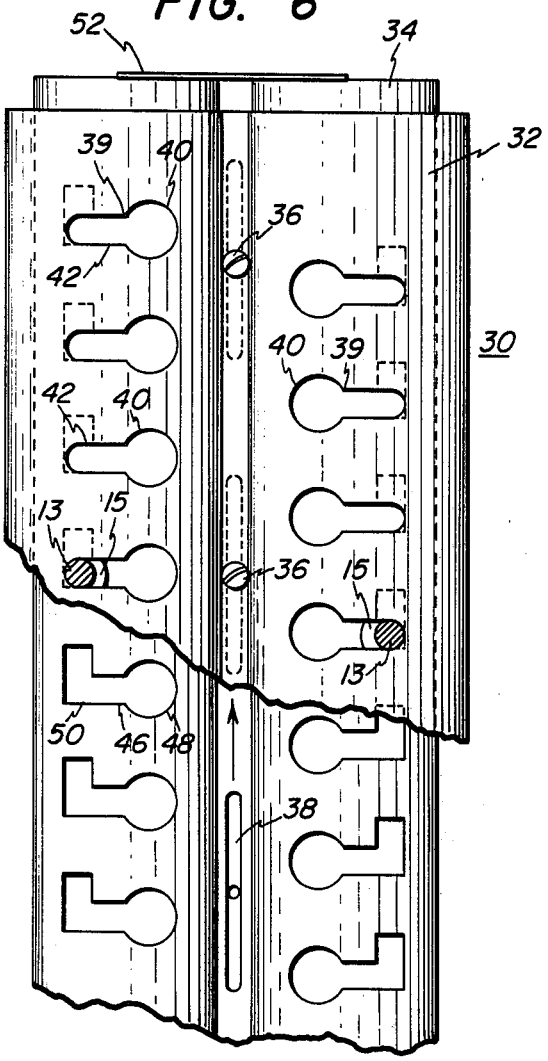
FIG. 6 is a plan view of a portion of the anchoring device of the invention.
Figure 7:
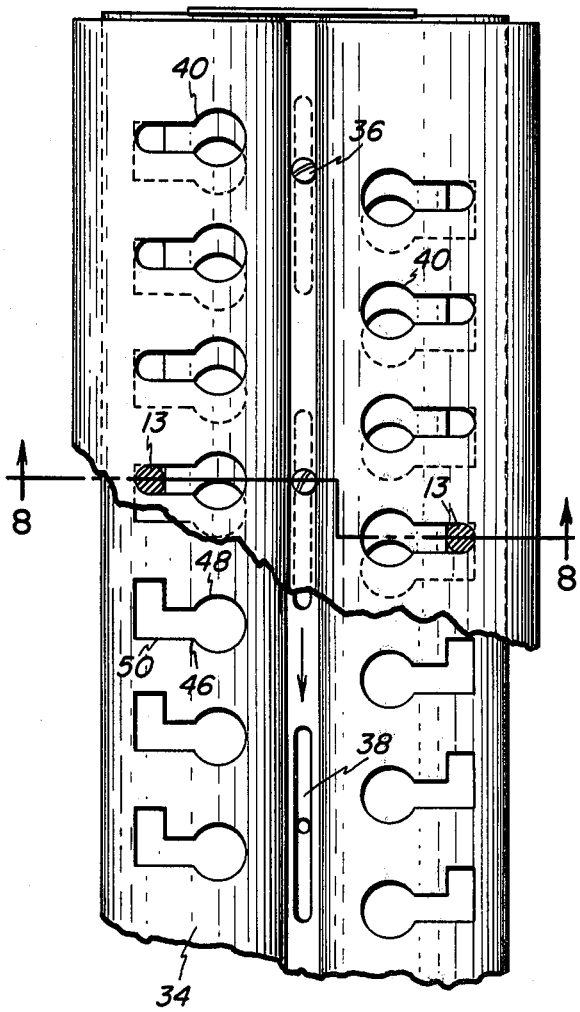
FIG. 7 is another plan view of the anchoring device illustrating the movement of one of its parts.
Figure 8:
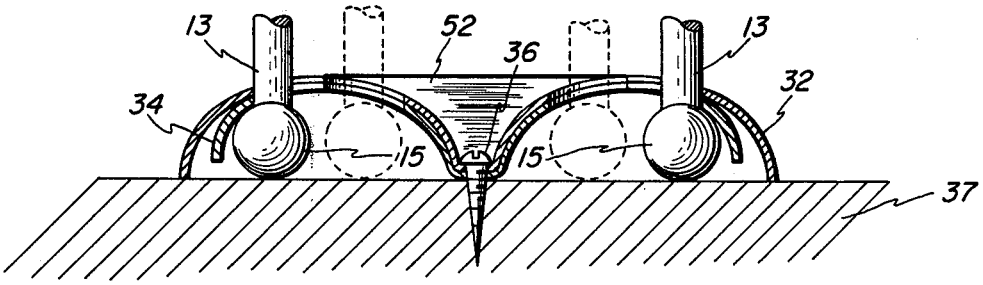
FIG. 8 is a cross-sectional view of the anchoring device of FIGS. 6 and 7 taken on line 8—8 of FIG. 7.

FIGS. 6, 7 and 8 depict an anchoring device 30 which may be attached to a wall or any other immovable structure. It is preferably about five feet in length. Anchoring device 30 includes outer plate 32 and inner plate 34. Both are held in place by means of screws 36 in a wall 37. In a typical installation, anchoring device 30 would be mounted vertically as shown in FIGS. 6 and 7 at a height where it would span the mid-portion of the user's body. Outer plate 32 is immovable while slots 38 permit inner plate 34 to be slid vertically by means of a handle 52. FIG. 6 shows plate 34 in its upper position and FIG. 7 shows plate 34 in its lower position.

A plurality of openings 39 are provided in outer plate 32. Each opening 39 consists of a rounded portion 40 for accepting the ball 15 of an exercise bar 10 and a channel portion 42 for accepting neck 13. Ball 15 and neck 13 are sufficiently small in diameter to freely pass through rounded portion 40 and channel portion 42 freely.

Bottom plate 34 is provided with openings 46 each comprised of a rounded portion 48 and a channel portion 50. These openings are large enough to freely accept ball 15 and neck 13 respectively. Channel portion 50 is generally L-shaped.

In operation, the user of the invention would first slide inner plate 34 upwardly by means of plate handle 52 until the rounded portions of the respective openings in plates 32 and 34 are aligned as shown in FIG. 6. Then, balls 15 of a pair (preferably) of exercising bars 10 are inserted through the rounded portions of the respective openings, as shown in phantom in FIG. 8. After insertion, balls 15 are moved sidewardly or horizontally in the channel portion of the respective openings to the outer positions shown by the solid lines in FIG. 8. Then, inner plate 34 is operated to its lower position, as shown in FIG. 7, thereby capturing balls 15. It is apparent that anchoring device 30 can be replaced by any suitable socket-type fixture capable of engaging and holding balls 15 so as to permit pivotal movement of the exercising bars 10.

Next, the user, standing between exercising bars 10, would grasp a handle 14 in each hand and commence to move it vertically while holding each exercise bar 10 against his body. In the preferred method of operation, the operator would cross his arms before grasping each handle 14, thereby enabling him to use a pulling grip on each handle to keep each exercise bar 10 pressed against his body more easily. When the user has finished a particular section of his body, he can adjust the height of the exercise bars by removing ball 15 from anchoring device 30 and relocating them at a different level. This is the purpose for having a plurality of openings, as shown. Persons of various heights are also accommodated in this way.

The system described enables the user to more easily apply a reasonably strong and sustained force on exercise bar 10 thereby pressing it against his body. Because one end is anchored, he is able to grip two exercise bars at the same time and is enabled to massage two different areas of the body simultaneously without becoming unduly fatigued.

It may occur to those skilled in the art that various modifications can be made to this invention without departing from its essence. It is intended to encompass all such modifications within the following appended claims.

I claim:

1. A massage and exercising system comprised of:

at least one central shaft;

a handle rotatably mounted on one end of each shaft;

a ball joint having a ball member connected to the other end of each shaft for anchoring said shaft for pivotal movement about said other end;

a plurality of massage rollers mounted on each shaft between the handle and the ball joint so as to be individually rotatable thereon;

a stationary plate which is fastened to a relatively immovable object, said stationary plate having at least one opening therein for each shaft to be anchored, each opening consisting of a rounded portion for accepting the ball member and a straight channel portion extending horizontally from the rounded portion, said straight portion having a width smaller than the diameter of the ball member for the captured movement of the ball member to the distal end of the channel; and a movable plate which is slideably mounted with regard to the stationary plate so as to be operable between an advanced and a retracted position, said movable plate having at least one opening consisting of a second rounded portion for accepting the ball member and a second horizontal channel portion extending from the second rounded portion and turning vertically at its distal end to form an "L" shape, said second rounded portion and said second horizontal channel being aligned with the opening(s) of the stationary plate when the movable plate is in its retracted position so that the ball member can be inserted through both rounded portions and slid horizontally along the channel portions to their distal ends thereby positioning said ball member to be captured when the movable plate is moved to its advanced position.

2. The invention of claim 1 wherein each plate contains a plurality of openings vertically positioned in two parallel rows so as to allow the engagement of at least one ball member at various heights for the massaging of different parts of the body, said rows also enabling the engagement of two ball members at the same height.

* * * * *